US010774434B2

(12) United States Patent
Proshkin et al.

(10) Patent No.: US 10,774,434 B2
(45) Date of Patent: Sep. 15, 2020

(54) METHOD FOR LINING A CATHODE ASSEMBLY OF A REDUCTION CELL FOR PRODUCTION OF PRIMARY ALUMINUM (VARIANTS)

(71) Applicant: United Company RUSAL Engineering and Technology Centre LLC, g. Krasnoyarsk (RU)

(72) Inventors: Aleksandr Vladimirovich Proshkin, g. Krasnoyarsk (RU); Vitalij Valer'evich Pingin, g. Krasnoyarsk (RU); Samuil Yakovlevich Levenson, g. Krasnoyarsk (RU); Andrej Gennad'evich Sbitnev, g. Krasnoyarsk (RU); Aleksej Vasil'evich Morozov, g. Krasnoyarsk (RU); Aleksej Sergeevich Zherdev, g. Krasnoyarsk (RU)

(73) Assignee: United Company Rusal Engineering and Technology Centre LLC, Kranoyarsk (RU)

( * ) Notice: Subject to any disclaimer, the term of this patent is extended or adjusted under 35 U.S.C. 154(b) by 177 days.

(21) Appl. No.: 15/746,736

(22) PCT Filed: Jul. 7, 2016

(86) PCT No.: PCT/RU2016/000422
§ 371 (c)(1),
(2) Date: Jan. 22, 2018

(87) PCT Pub. No.: WO2017/018911
PCT Pub. Date: Feb. 2, 2017

(65) Prior Publication Data

US 2018/0223441 A1 Aug. 9, 2018

(30) Foreign Application Priority Data

Jul. 24, 2015 (RU) ..... 2015130966

(51) Int. Cl.
*C25C 3/08* (2006.01)

(52) U.S. Cl.
CPC ..... *C25C 3/085* (2013.01)

(58) Field of Classification Search
CPC .... C25C 3/00; C25C 3/06; C25C 3/08; C25C 3/085
See application file for complete search history.

(56) References Cited

U.S. PATENT DOCUMENTS 3,314,876 A * 4/1967 Ransley ..... C25C 3/16 204/291
3,330,756 A * 7/1967 Ransley ..... C04B 35/645 204/279
3,400,061 A * 9/1968 Lewis ..... C25C 3/08 205/375
5,005,631 A * 4/1991 Dwivedi ..... C04B 41/009 164/97
5,016,703 A * 5/1991 Aghajanian ..... C04B 41/009 164/97
5,020,584 A * 6/1991 Aghajanian ..... B22F 3/26 164/97

FOREIGN PATENT DOCUMENTS

| | | | |
|---|---|---|---|
| CN | 1136600 | A * | 11/1996 |
| CN | 101665955 | A | 3/2010 |
| CN | 101665955 | * | 10/2010 |
| CN | 102146568 | A * | 8/2011 |
| RU | 2113550 | C1 * | 6/1998 |
| RU | 2266983 | C1 * | 12/2005 |
| RU | 2385972 | C1 * | 4/2010 |
| SU | 1183564 | A1 * | 10/1985 |

OTHER PUBLICATIONS

Use of a Thin Monolithic Sheet as a Barrier to the Vertical Miigratiion of Hall Cell Bath Constituents into the Bottom Insulation by J. C. Chapman Light Metal Proc.of Sessions, TMS Annual Meeting (Warrendale PA ( vol. 1, p. 303, Jan. 1, 1978).*
Japan Pat 58501182 A,published Jul. 21, 1983 (Baktar et al).*
International Search Report for PCT/RU2016/000422 dated Nov. 24, 2016.

* cited by examiner

*Primary Examiner* — Carl J Arbes
(74) *Attorney, Agent, or Firm* — Hogan Lovells US LLP

(57) ABSTRACT

The present invention relates to nonferrous metallurgy, in particular to the process equipment for electrolytic production of primary aluminum, namely to methods for lining cathode assemblies of reduction cells. The method for lining a cathode assembly of a reduction cell for production of aluminum comprises filling a cathode assembly shell with a thermal insulation layer, forming a fire-resistant layer followed by the compaction of layers, installing bottom and side blocks followed by sealing joints therebetween with a cold ramming paste. According to the first embodiment of the present invention, a resilient element made of a dense organic substance is placed between the thermal insulation layer and the fire-resistant layer. According to the second embodiment of the present invention, a flexible graphite foil is placed between the thermal insulation layer and the fire-resistant layer, and under the flexible graphite foil, a resilient element made of a dense organic substance is placed. The suggested variants of methods for lining a cathode assembly of a reduction cell for production of primary aluminum allow to reduce energy consumption for reduction cell operation by means of improved stability of thermal and physical properties in a base and to increase the service life of reduction cells.

8 Claims, 5 Drawing Sheets

METHOD FOR LINING A CATHODE ASSEMBLY OF A REDUCTION CELL FOR PRODUCTION OF PRIMARY ALUMINUM (VARIANTS)

This application is a U.S. National Phase under 35 U.S.C. § 371 of International Application PCT/RU2016/000422, filed on Jul. 7, 2016, which claims priority to Russian application 2015130966, filed on Jul. 24, 2015. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The present invention relates to nonferrous metallurgy, in particular to the process equipment for electrolytic production of primary aluminum, namely to methods for lining cathode assemblies of reduction cells.

It is known a method for lining which comprises installing a thermal insulation layer including successive filling and compacting calcined alumina in a cathode assembly shell in two layers of different density: an upper layer density is 1.2-1.8 tonnes/m3, a lower layer density is 0.8-1.1 tonnes/m3; laying a barrier of firebricks; installing bottom and side blocks followed by sealing joints therebetween with a cold ramming paste (A.C. SU No. 1183564, IPC C25C 3/08, published on Jul. 10, 1985).

The drawbacks of this lining method include high costs for deep-calcined alumina which is pre-calcinated at temperatures above 1200° C.; increased energy consumption for reduction cell operation due to the instability of temperature fields in a cathode assembly caused by the penetration of electrolyte components across joints between firebricks and the change in thermal and physical characteristics of an underlying thermal insulation layer; high labor costs for laying the fire-resistant layer, as well as higher heat losses due to the high thermal conductivity coefficient of the insulation layer made of α-A1203.

It is known a method for lining a cathode assembly of a reduction cell for production of primary aluminum which comprises installing a thermal insulation layer of 2 or 3 layers of diatomite and vermiculite plates; installing a barrier material made of a flexible graphite foil in combination with steel sheets; laying firebricks; installing bottom and side blocks followed by sealing joints therebetween with a cold ramming paste (J. C. Chapman and H. J. Wilder Light Metals, Vol.1 (1978) 303).

The drawbacks of this lining method are in that the flexible graphite foil in combination with steel sheets cannot serve as a long-term barrier. In particular, according to the results of the reduction cell autopsy, the steel sheets were intact only on the periphery covering only 10% of the cathode assembly area. On the rest of the zone, they were damaged.

The closest to the claimed method in terms of its technical features is a method for lining a cathode assembly of a reduction cell for production of aluminum which comprises filling a cathode assembly shell with a thermal insulation layer consisting of non-graphitic carbon or an aluminosilicate or aluminous powder and pre-mixed with non-graphitic carbon; forming a fire-resistant layer by filling with an aluminous powder followed by its vibro-compaction to obtain an apparent porosity no more than 17%; installing bottom and side blocks followed by sealing joints therebetween with a cold ramming paste (Patent RU 2385972, IPC C25C3/08, published on Oct. 4, 2010).

The drawback of such lining method is in that it is accompanied by intensive heat losses through the bottom of the reduction cell due to the high thermal conductivity coefficient of compacted layers of non-graphitic carbon or an aluminosilicate or aluminous powder pre-mixed with non-graphitic carbon leading to increased energy consumption and reduced service life of a reduction cell.

The present invention is based on the idea to provide a lining method which helps to reduce energy consumption for reduction cell operation and increase its service life.

The object of the present invention is to provide a lining of a cathode reduction cell with improved barrier properties, to optimize thermal and physical characteristics of lining materials of a reduction cell base, to decelerate the penetration of components of a cryolite-alumina melt and to reduce wastes of lining materials to be disposed of after disassembling.

Said technical effect according to the first embodiment is achieved by that in the method for lining a cathode assembly of a reduction cell for production of aluminum which comprises filling a cathode assembly shell with a thermal insulation layer, forming a fire-resistant layer followed by the compaction of layers, installing bottom and side blocks followed by sealing joints therebetween with a cold ramming paste, a resilient element made of a dense organic substance is placed between the thermal insulation layer and the fire-resistant layer.

The inventive method according to the first embodiment is completed with specific features helping to achieve the claimed technical effect.

The porosity of a fire-resistant layer can be varied in the range of 15 to 22%, and the porosity of a thermal insulation layer can be varied in the range of 60 to 80%.

Said technical effect according to the second embodiment is achieved by that in the method for lining a cathode assembly of a reduction cell for production of aluminum which comprises filling a cathode assembly shell with a thermal insulation layer, forming a fire-resistant layer followed by the compaction of layers, installing bottom and side blocks followed by sealing joints therebetween with a cold ramming paste, a flexible graphite foil is placed between the thermal insulation layer and the fire-resistant layer, and under the flexible graphite foil a resilient element made of a dense organic substance is placed.

The inventive method according to the second embodiment is completed with specific features helping to achieve the desired claimed technical effect.

A foil having the density of 1 g/cm$^3$ and gas-permeability no more than $10^{-6}$ cm$^3$·cm/cm$^2$·s·atm which is manufactured by rolling of the enriched crystalline graphite can be used as a flexible graphite foil. Additionally, a resilient element made of a dense organic substance can be installed on top of the flexible graphite foil.

The inventive method according to first and second embodiments complements a particularly distinctive feature which helps to achieve the claimed technical effect.

As a resilient element made of a dense organic substance a dense fibreboard having a thickness of $(2.5\div4)*10^{-4}$ of the width of a cathode can be used.

A comparative analysis of the features of the claimed solution and the features of the analog and prototype has shown that the solution meets the "novelty" requirement.

Figure 1:
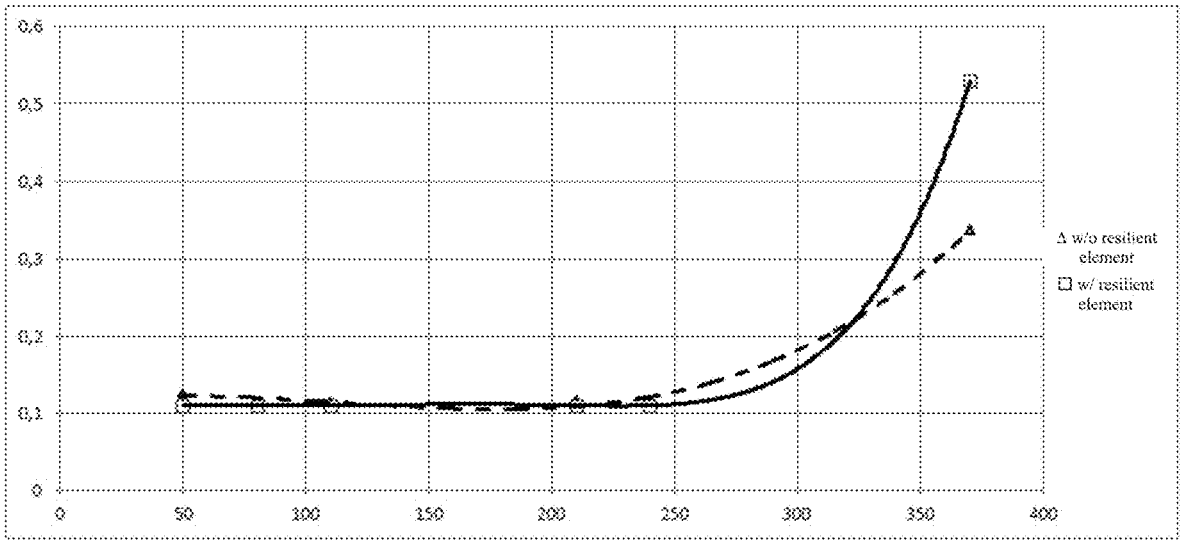
FIG. 1 shows results of research assessing the impact of a resilient element placed between a thermal insulation layer and a fire-resistant layer on thermal conductivity coefficients of materials in the height of an element of a reduction cell base.
Figure 2:
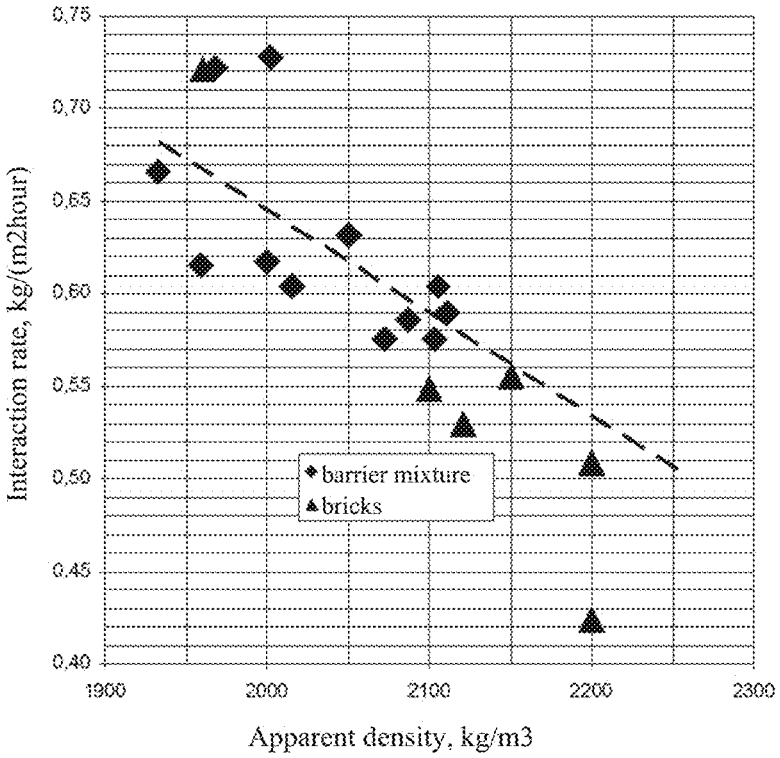
FIG. 2 shows results of research assessing the impact of the density of the fire- resistant layer on cryolite resistance.
Figure 3:
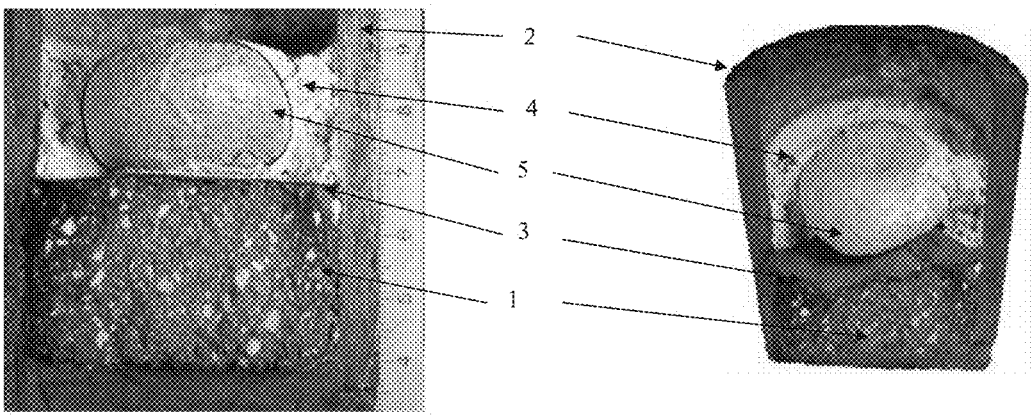
FIG. 3 shows the outcome of the evaluation of the resistance of a flexible graphite foil to aggressive components in a laboratory setting.
Figure 4:
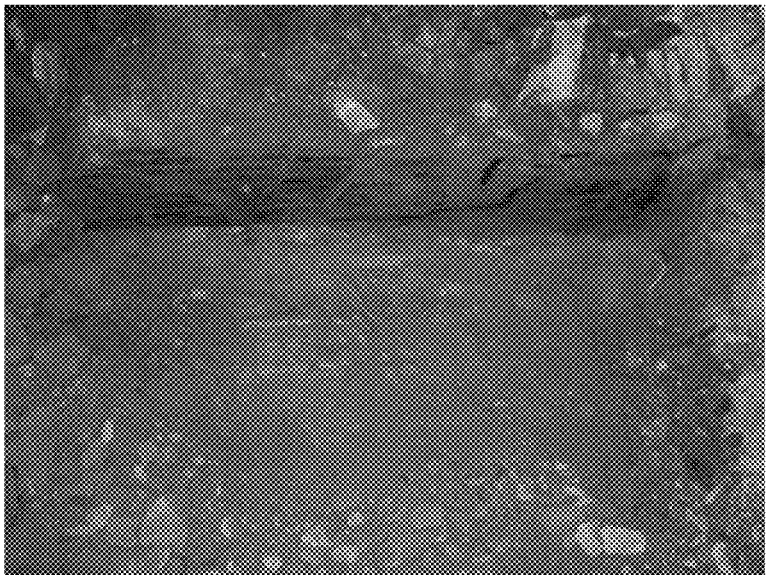
FIG. 4 shows the state of a flexible graphite foil which has been used in a cathode assembly of a reduction cell for production of primary aluminum for six years.
Figure 5:
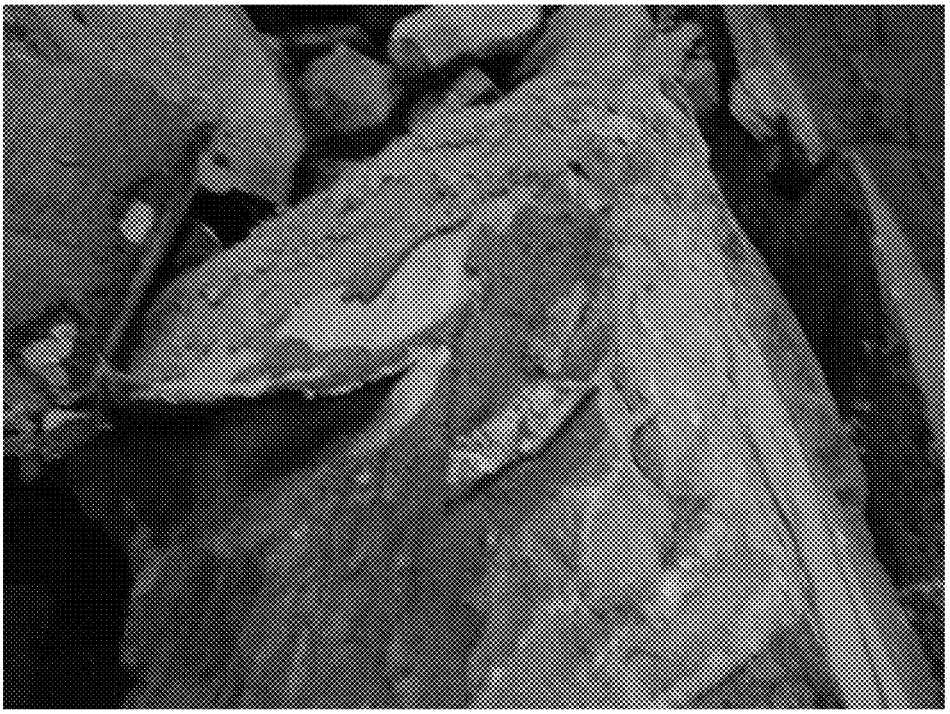
FIG. 5 shows a piece of a flexible graphite foil which has prevented aluminum penetration into the thermal insulation layer.

The essence of the invention will be better understood upon studying following figures, where FIG. 1 shows results of researches assessing the impact of a resilient element placed between a thermal insulation layer and a fire-resistant layer on thermal conductivity coefficients of materials in the height of an element of a reduction cell base. FIG. 2 shows results of researches assessing the impact of the density of the fire-resistant layer on cryolite resistance. FIG. 3 shows the outcome of the evaluation of the resistance of a flexible graphite foil to aggressive components in a laboratory setting, and FIG. 4 shows the state of a flexible graphite foil which has been used in a cathode assembly of a reduction cell for production of primary aluminum for six years. FIG. 5 shows a piece of a flexible graphite foil which has prevented aluminum penetration into the thermal insulation layer. As can be seen from the represented data, since the wetting angle is small, aluminum has "spread" over the foil as a flat plate.

If reduction cell bases are lined by means of either shaped or non-shaped lining materials it is necessary to satisfy all conflicting requirements to their structure. Lower layers must have the highest possible porosity (constrained by limiting conditions of the 10% shrinkage), and top, fire-resistant, layers arranged directly under bottom blocks, on the contrary, must have the minimum porosity (in the range of 15-17%). When using non-shaped materials, simultaneous compaction of the thermal insulation layer and the fire-resistant layer inevitably leads to compaction of the entire mass, thus, negatively affecting thermal and physical properties of the lower thermal insulation layer—its thermal conductivity coefficient becomes higher. The installation of a resilient element made of a dense organic substance helps to redistribute the relative shrinkage of these layers and, consequently, to change the density as desired: the density of upper layers increases and the density of lower layers decreases.

Suggested parameters of layer density are optimal. As the result of compaction of the fire-resistant material to obtain the layer porosity more than 22%, a permeable macrostructure is achieved and the interaction reaction goes throughout the entire material leading to poorer thermal and physical properties and reducing the service life of the reduction cell. It is impossible to obtain a layer having the porosity lower than 15% applying only the compaction operation.

If the porosity of the thermal insulation layer is lower than 60%, it reduces the thermal resistance of a base, increases thermal losses, on the bottom surface incrustations are formed which create obstacles for processes of aluminum production, thus, increasing energy consumption and reducing the service life of reduction cells. The porosity of more than 80% increases the risk of shrinkage of the thermal insulation layer and all the structural elements arranged above, as well as a reduction cell failure.

Experiments with the compaction process and the behavior of a compacted material were carried out using a laboratory bench consisted of a rectangular container for a material and a vibration device for compaction thereof. For the purpose of the experiments, a thermal insulation material, in particular partially carbonized lignite (PCL), was filled and horizontally leveled in the rectangular container on the bench. The initial thickness of this layer is reported in the table below in millimeters. On top of a thermal insulation layer, a fire-resistant layer of a dry barrier mix (DBM) was filled and leveled, wherein, for one test sample, a resilient element made of a dense organic substance was placed between the thermal insulation layer and the fire-resistant layer. The initial thickness of the fire-resistant (DBM) layer is reported in the table below in millimeters. In order to prevent extrusion of the mix, on top of the leveled DBM layer was laid a polyethylene film, whereon a 2.5 mm steel plate and a rubber conveyor belt with the thickness of 14 mm were placed. Further, on top of the steel plate, a local unit of a vibration device VPU was installed and the entire mass was compacted. The compaction process was followed by bench disassembling and changing the degree of compaction of the thermal insulation layer and the fire-resistant layer. The table below shows the results of compaction of a non-shaped material at the VPU rate 0.44 m/s. Final thicknesses of each layer for both test samples are reported in the table below in millimeters, as well as the overall shrinkage of each layer, also reported in millimeters.

TABLE

| | W/o resilient element | | | W/ resilient element | | |
|---|---|---|---|---|---|---|
| Compaction stages | DBM Layer (mm) | PCL Layer (mm) | Total (DBM + PCL layers) (mm) | DBM Layer (mm) | PCL Layer (mm) | Total (DBM + PCL layers) (mm) |
| Initial | 130 | 320 | 450 | 130 | 317 | 447 |
| Final | 108 | 272 | 380 | 91 | 291 | 382 |
| Shrinkage | −22 | −48 | −70 | −39 | −26 | −65 |

As can be seen from the shown results, when using an intermediate resilient element between a thermal insulation layer and a fire-resistant layer the total shrinkage of non-shaped materials decreases from 70 to 65 mm Further, the shrinkage of the fire-resistant layer DBM almost doubled (from 22 to 39 mm), and the shrinkage of the thermal insulation layer was reduced from 48 to 22 mm which has become beneficial for the thermal conductivity coefficients of lining material layers (FIG. 1). In addition to the increase in the thermal insulation layer thickness and the decrease in the fire-resistant layer thickness, the total thermal resistance of the reduction cell base is increased. In this case, the denser upper fire-resistant layers prevent the penetration of molten fluoride salts. The following experiments with different rates of the VPU have shown that installation of a resilient element made of a dense organic substance between a thermal insulation layer and a fire-resistant layer provides for a decrease in the density of a PCL layer from 653-679 kg/m3 to 618-635 kg/m3. The use of a resilient element between a thermal insulation layer and a fire-resistant layer makes it possible to reduce the amount of used (and, consequently, to be recycled) partially carbonized lignite to 9%. The increased shrinkage of the fire-resistant layer is beneficial for deceleration of impregnation processes of the liquid electrolyte of base materials since it results in the reduced number and sizes of pores.

The data presented in FIG. 2 show that that the higher density of a fire-resistant layer reduces the rate of interaction of molten fluoride salts with the fire-resistant material to 40% which will positively affect the service life of reduction cells. Industrial tests for the said method for lining with non-shaped materials of reduction cells of the type "S-175" have confirmed the main principles of the inventive method.

Introduction of a barrier of a flexible graphite foil together with installation of a resilient element made of a dense organic substance between a thermal insulation layer and a fire-resistant layer protects the most sensitive part of lining materials—the thermal insulation layers—from penetration of liquid fluoride salts and molten aluminum and maintains the stable thermal balance of reduction cells for production of primary aluminum. A resilient element made of a dense organic substance, such as a fiberboard with a thickness of $(2.5 \div 4)*10^{-4}$ of the cathode width, protects the foil during the installation procedure from mechanical damages by sharp edges of non-shaped lining materials, and during the start-up and following usage thermal decomposition products of sheets of organic substance protect the foil from oxidation by lining materials. A resilient element made of a dense organic substance is laid on top of a thermal insulation layer and on top of the resilient element; a flexible graphite foil is laid. The resilient element made of a dense organic substance forms a robust base helping to maintain foil shape and properties and to achieve the claimed technical effect. The additional foil protection provided by the resilient element from the top further helps to save the foil.

In order to evaluate in a laboratory setting the resistance of the flexible graphite foil to aggressive components of a tank of a cathode assembly a test was carried out comprising in that a sample of a lining material 1 was lathe machined and placed into a graphite crucible 2, covered with a graphite foil 3 carefully fitted to walls of the graphite casing and on the graphite foil fluoride salts 4 and aluminum 5 were placed. Said combination allowed to make aggressive components such as sodium vapors, fluoride salts and molten aluminum act in the complex. The graphite crucible was covered by a sealing cover and placed into a shaft furnace СШОЛ -80/12. After heating for 4 hours and holding at 950° C. for 20 hours, the sample was left to cool down and was removed from the crucible by cutting it apart. It has been determined that the flexible graphite foil possesses great protective characteristics (FIG. 3).

Suggested parameters of the density of the flexible graphite foil are optimal. The higher than the claimed density (1 $g/cm^3$) will lead to the foil cost increase and to the loss of cost-effectiveness, and the lower compared to the claimed density will result in the increased gas permeability (no more than $10^{-16}$ $m^2$) which will deteriorate protective properties of the foil. The higher than the claimed thickness of the fiberboard ($4*10^{-4}$ of the cathode assembly width) will lead to the cost increase and increase the risk of shrinkage, and the thickness less than $2.5*10^{-4}$ of the cathode assembly width will not protect the foil from the negative impact of sharp edges of non-shaped materials.

Compared to the prototype, the suggested variants of methods for lining a cathode assembly of a reduction cell for production of primary aluminum allow to reduce energy consumption for reduction cell operation by means of improved stability of thermal and physical properties in a base and to increase the service life of reduction cells.

The invention claimed is:

1. A method for lining a cathode assembly of a reduction cell for production of aluminum, the method comprising:
- filling a cathode assembly shell with a thermal insulation layer;
- placing a resilient element made of a dense organic substance on the thermal insulation layer;
- forming a fire-resistant layer on the resilient element, such that the resilient element is between the thermal insulation layer and the fire-resistant layer;
- compacting the thermal insulation layer, the resilient element, and the fire-resistant layer;
- installing bottom and side blocks; and
- sealing joints therebetween with a cold ramming paste.

2. The method according to claim 1, characterized in that the porosity of the fire-resistant layer ranges from 15% up to and including is 22%.

3. The method according to claim 1, characterized in that the porosity of the thermal insulation layer ranges from 60% up to and including 80%.

4. The method according to claim 1, characterized in that the resilient element is made of a dense fibreboard and has a thickness of $0.625*10^{-4}$ times a width of the cathode assembly.

5. A method for lining a cathode assembly of a reduction cell for production of aluminum, the method comprising:
- filling a cathode assembly shell with a thermal insulation layer;
- placing a flexible graphite foil on the thermal insulation layer;
- forming a fire-resistant layer on the flexible graphite foil, such that the flexible graphite foil is between the thermal insulation layer and the fire-resistant layer;
- compacting the thermal insulation layer, the flexible graphite foil, and the fire-resistant layer;
- installing bottom and side blocks; and
- sealing joints therebetween with a cold ramming paste.

6. The method according to claim 5, characterized in that the flexible graphite foil has a density of 1 g/cm3 and a gas-permeability of no more than $10^{-16}$ $m^2$ .

7. The method according to claim 5, further comprising installing a resilient element made of the dense organic substance on top of the flexible graphite foil.

8. The method according to claim 7, characterized in that the resilient element is made of a dense fibreboard and has a thickness of $0.625*10^{-4}$ times a width of the cathode assembly.

* * * * *